US008231204B2

(12) United States Patent
Jindai et al.

(10) Patent No.: US 8,231,204 B2
(45) Date of Patent: Jul. 31, 2012

(54) LIQUID EJECTION HEAD AND METHOD FOR MANUFACTURING LIQUID EJECTION HEAD

(75) Inventors: Kazuhiro Jindai, Yokohama (JP); Yuji Tsuruoka, Kawasaki (JP); Takashi Mori, Tokyo (JP); Nobuhito Yamaguchi, Inagi (JP); Masao Furukawa, Yokohama (JP); Seiichi Kamiya, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 1106 days.

(21) Appl. No.: 12/116,808

(22) Filed: May 7, 2008

(65) Prior Publication Data

US 2009/0009559 A1 Jan. 8, 2009

(30) Foreign Application Priority Data

May 8, 2007 (JP) ..... 2007-123664

(51) Int. Cl.

| | |
|---|---|
| ***B41J 2/05*** | (2006.01) |
| ***B41J 2/14*** | (2006.01) |
| ***B41J 2/16*** | (2006.01) |

(52) U.S. Cl. ..... 347/50; 347/58

(58) Field of Classification Search ..... 347/40, 347/48–50, 55, 58, 59, 20, 44, 47, 56, 67
See application file for complete search history.

(56) References Cited

U.S. PATENT DOCUMENTS

| | | | | |
|---|---|---|---|---|
| 6,188,414 | B1 * | 2/2001 | Wong et al. | 347/42 |
| 6,554,399 | B2 * | 4/2003 | Wong et al. | 347/44 |
| 6,991,315 | B2 * | 1/2006 | Nakamura et al. | 347/40 |

FOREIGN PATENT DOCUMENTS

| | | |
|---|---|---|
| JP | 2001-150680 | 6/2001 |
| JP | 2004-237528 | 8/2004 |
| JP | 2007-055090 A | 3/2007 |
| JP | 2007-083680 A | 4/2007 |
| JP | 2007-090853 A | 4/2007 |

* cited by examiner

*Primary Examiner* — Hai C Pham
(74) *Attorney, Agent, or Firm* — Canon USA Inc IP Division

(57) ABSTRACT

The present invention provides liquid ejection head enables a reduction in the distance between a print medium and an ejection port formation face of the liquid ejection head on which an ejection port is formed, improving the landing accuracy of droplets ejected from the liquid ejection head. A print head according to the present invention includes an element substrate and a supporting member. A supporting portion is located in the space between the element substrate and the supporting member. Connection wiring is formed on the supporting portion. The connection wiring is provided which connects wiring inside of the supporting member provided in the supporting member to the heat generating element.

8 Claims, 3 Drawing Sheets

LIQUID EJECTION HEAD AND METHOD FOR MANUFACTURING LIQUID EJECTION HEAD

BACKGROUND OF THE INVENTION

1. Field of the Invention

The present invention relates to a liquid ejection head having an ejection energy generating element that generates and applies energy to a liquid to eject the liquid through an ejection port, as well as a method for manufacturing such a liquid ejection head.

2. Description of the Related Art

Printing apparatuses using a liquid ejection head to eject droplets intrinsically eject droplets onto a print medium such as paper in a non-contact manner to attach the droplets to the print medium for printing. However, recent printing apparatuses using a liquid ejection head have more frequently been applied to print media other than paper. These printing apparatus have been used for printing on fibers, that is, textile printing, printing of circuits for manufacturing electric circuits, printing on glass substrates, or the like. For these printing apparatuses, one of a major factor affecting the quality of output images printed on print media is the landing accuracy of droplets. When the printing apparatus is used to print circuits in manufacturing electric circuits, the landing accuracy also affects the accuracy of the electric circuits. Thus, the landing accuracy of droplets from the liquid ejection head is an element determining the performance of the printing apparatus.

To allow the liquid ejection head to eject a liquid, an ejection energy generating element provided in the liquid ejection head needs to be energized. The liquid ejection head further has a connection portion that electrically connects wiring formed in a supporting member to the ejection energy generating element.

In general, the connection portion is desirably formed in position retracted from an ejection port formation face of the liquid ejection head on which an ejection port is formed, with respect to a direction in which droplets are ejected. If any area of the liquid ejection head projects from the ejection port formation face in the droplet ejecting direction, the projection correspondingly prevents the ejection port formation face of the liquid ejection head from being located closer to the print medium. Thus, to design a printing apparatus using a liquid ejection head having a portion projecting from the ejection port formation face in the ejection direction, it is necessary to design the apparatus taking into account the distance by which the projecting portion of the liquid ejection head projects from the ejection port formation face. This increases the distance between the ejection port formation face of the liquid ejection head and the print medium. The increased distance between the ejection port formation face of the liquid ejection head and the print medium may reduce the landing accuracy of ejected droplets. This may in turn degrade the quality of output images.

If the printing apparatus is designed such that the liquid ejection head are located very close to the print medium, in order to maintain the appropriate landing accuracy, then when for example, slight cockling occurs on the print medium, the projecting portion of the liquid ejection head may contact the print medium. In such a case, a surface of the print medium may be damaged, also degrading the quality of output images. If the liquid ejection head is used to print circuits in manufacturing electric circuits, the degraded quality of output images may affect the electrical characteristics of the electric circuits.

Japanese Patent Laid-Open No. 2004-237528 discloses a liquid ejection head having a connection portion which electrically connects a supporting member and an ejection energy generating element, and which has a reduced height. In the liquid ejection head disclosed in Japanese Patent Laid-Open No. 2004-237528, edge lines of a substrate is chamfered to prevent the wiring from contacting the substrate. This makes it possible to provide the liquid ejection head in which the connection portion is located farther than the ejection port formation face. In the liquid ejection head disclosed in Japanese Patent Laid-Open No. 2004-237528, the connection portion is located lower to reduce the size of the portion of the liquid ejection head which projects from the ejection port formation face. The smaller projecting portion reduces the distance between the ejection port formation face of the liquid ejection head and the print medium. This improves the landing accuracy of a liquid ejected from the liquid ejection head.

However, when the electric connection between the supporting member and the ejection energy generating element is established according to such a method as proposed in Japanese Patent Laid-Open No. 2004-237528, the wiring is located as the wiring is laid across between the supporting member and an element substrate at the connection portion. Consequently, the wiring at the connection portion functions as wiring allowing electricity to pass through while supporting the own weight. The wiring thus needs to have a sufficient strength to support the own weight. To have an increased strength, the wiring needs to be formed to be thicker. The wiring thus becomes thicker in the ejection direction, causing the connection portion of the liquid ejection head to project correspondingly in the liquid ejection direction. This increases the size of the portion of the liquid ejection head which projects from the ejection port formation face in the ejection direction. The liquid ejection head may thus be prevented from lying closer to the print medium, increasing the distance between the liquid ejection head and the print medium. The increased distance between the liquid ejection head and the print medium correspondingly reduces the landing accuracy of ejected droplets.

SUMMARY OF THE INVENTION

The present invention is directed to a liquid ejection head which enables a reduction in the distance between a print medium and an ejection port formation face of the liquid ejection head on which an ejection port is formed, improving the landing accuracy of droplets ejected from the liquid ejection head.

According to an aspect of the present invention, a liquid ejection head includes an element substrate, a supporting member, and a supporting portion. The element substrate has a flow path forming member including an ejection port formed therein and through which droplets are ejected and an ejection energy generating element configured to generate energy to eject the droplets. The supporting member includes wiring through which electricity is transmitted to drive the ejection energy generating element. The supporting portion is located in the supporting member. The connection wiring, formed of only a conductive material and connecting the wiring inside of the supporting member to the ejection energy generating element, is located on the supporting portion.

The liquid ejection head according to the present invention allows the connection wiring to be formed of a small amount of conductive material. This enables a reduction in the amount by which the electric connection portion of the liquid ejection head projects in the droplet ejection direction. Thus, the ejection port formation face of the liquid ejection head can be located close to the print medium. Therefore, the landing accuracy of droplets ejected from the liquid ejection head can be improved.

According to another aspect of the present, a method for manufacturing the above liquid ejection head includes placing the element substrate in a supporting member, placing a supporting portion in a space between the element substrate and the supporting member, and then fixing the element substrate to the supporting member; and placing a conductive material on the supporting portion that was placed in the step of placing the element substrate in order to form connection wiring connecting the wiring provided in the supporting member to the ejection energy generating element.

Furthermore, with the method for manufacturing the liquid ejection head according to the present invention, in the connection wiring forming step, the connection wiring is placed so as to be supported by the support portion placed with the element substrate in the step of placing the element substrate. The connection wiring thus is required only a little strength. Consequently, the connection wiring is formed thinner. This enables a reduction in the amount by which the electric connection portion of the liquid ejection head projects in the droplet ejection direction. As a result, the ejection port formation face of the liquid ejection head can be located close to the print medium.

Further features of the present invention will become apparent from the following description of exemplary embodiments (with reference to the attached drawings).

BRIEF DESCRIPTION OF THE DRAWINGS

FIGS. 3A to 3D are diagrams illustrating a method for manufacturing a print head according to the present invention, wherein FIG. 3A shows that wiring inside of the supporting member is formed in a supporting member, FIG. 3B shows that a element substrate is placed in and fixed to the supporting member, FIG. 3C shows that connection wiring is formed, and FIG. 3D shows that the connection wiring is covered with a sealing compound.

DESCRIPTION OF THE EMBODIMENTS

Embodiments of the present invention will be described below with reference to the accompanying drawings.

Figure 1:
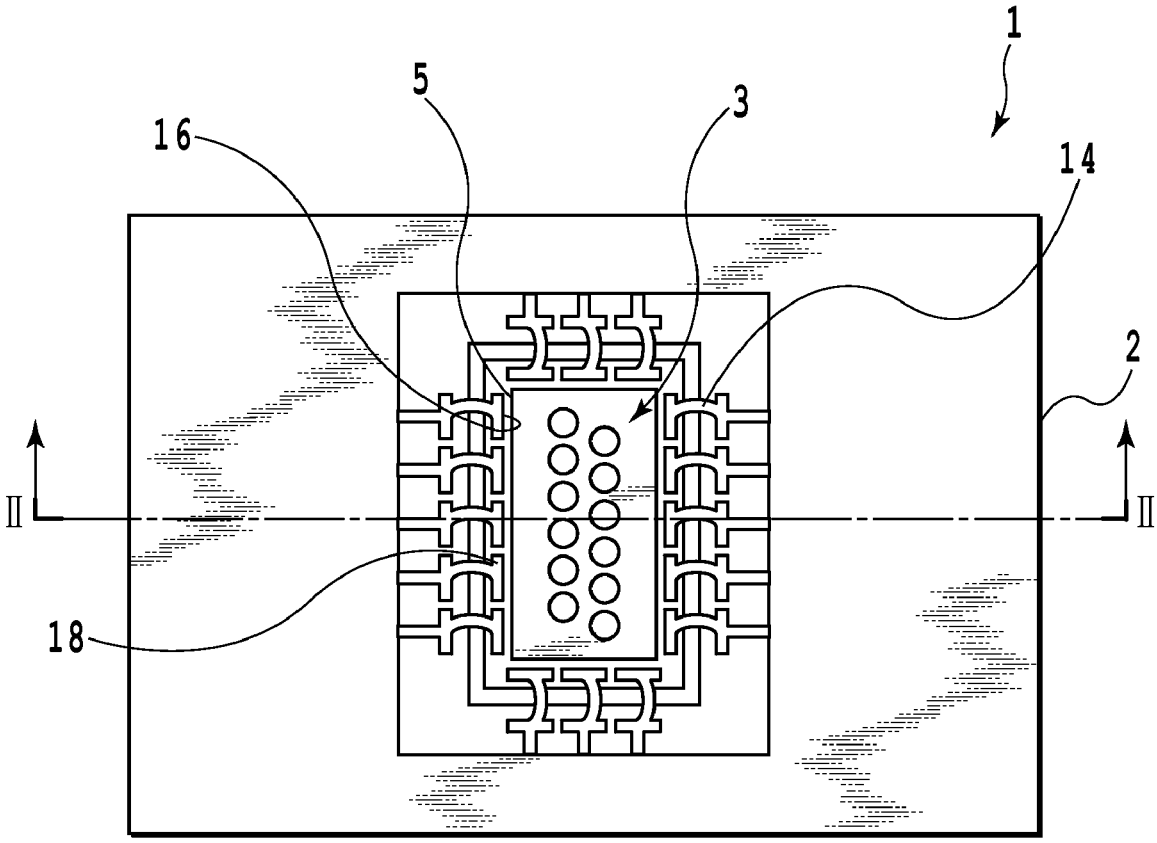
FIG. 1 is a plan view of a print head according to the present invention.
Figure 2:
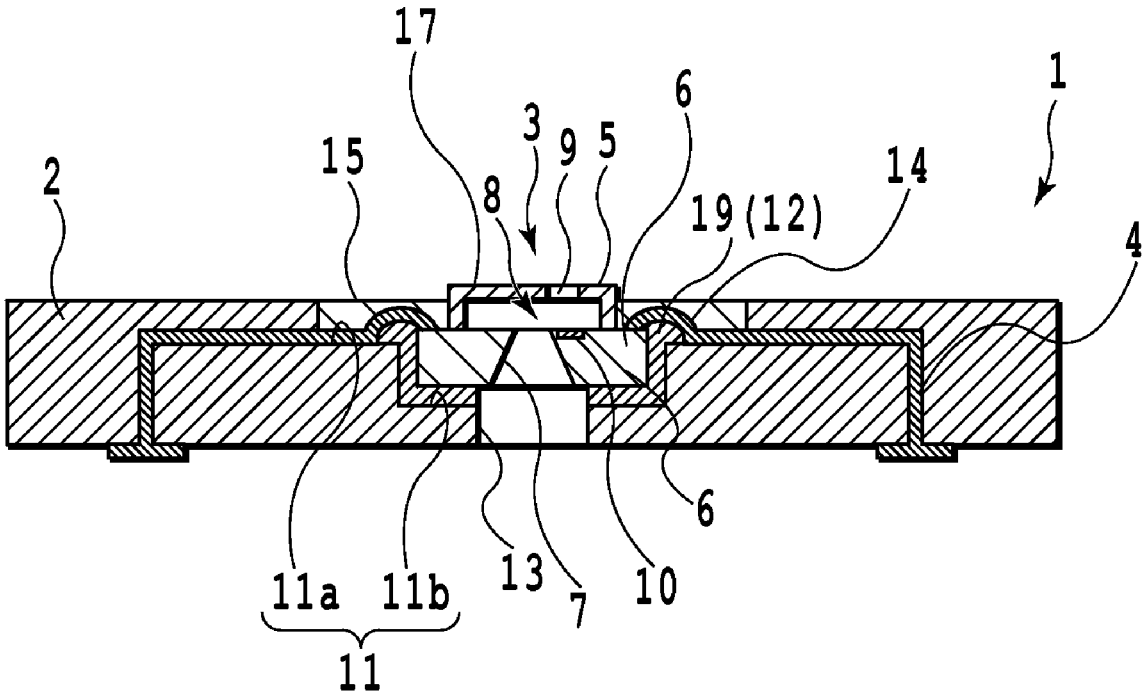
FIG. 2 is a sectional view of the print head taken along line II-II in FIG. 1.

FIG. 1 is a plan view of a print head 1 as a liquid ejection head according to the present invention. FIG. 2 is a sectional view of the print head 1 taken along line II-II in FIG. 1. The print head 1, used in the present embodiment, functions as an ink jet print head used for an ink jet printing apparatus ejecting ink onto a print medium.

The print head 1, shown in FIGS. 1 and 2, has a supporting member 2 and an element substrate 3. The supporting member 2 has wiring inside of the supporting member 4 formed therein and through which electricity is transmitted. In the present embodiment, the wiring inside of the supporting member 4 is embedded in the supporting member 2. Consequently, the supporting member 2, formed of an insulating material, prevents electricity passing through the wiring inside of the supporting member 4 from flowing through the other parts.

The element substrate 3 is formed by joining a flow path forming member 5, having an ejection port 9 through which ink is ejected and an ink flow path formed therein and communicating with the ejection port 9, and a supporting substrate 6 together. An ink supply port 7 is formed through the supporting substrate 6 in order to feed ink into the print head 1. The supporting substrate 6 and the flow path forming member 5 are joined together to define a common liquid chamber 8 between the supporting substrate 6 and the flow path forming member 5. The common liquid chamber 8 is in communication with the ink supply port 7. The ejection port 9 that is in communication with the common liquid chamber 8 is formed in the flow path forming member 5 such that ink is ejected through the ejection port 9. A heat generating element 10 is provided at a position corresponding to the ejection port 9 in the supporting substrate 6 and serves as an ejection energy generating element that generates energy utilized to eject ink through the ejection port 9.

The heat generating element 10 is an electrothermal transducing element that generates heat when energized. The element substrate 3 has wiring inside of the element substrate 16 formed therein and connected to the heat generating element 10. Terminals 18 are formed at an end of the wiring inside of the element substrate 16, which is opposite the heat generating element 10. The terminals 18 are arranged and patterned on the element substrate 3 so as not to reach the flow path forming member 5. The wiring inside of the element substrate 16, including the terminals 18, and the wiring inside of the supporting member 4 allow for the transmission of electricity required to drive the heat generating element 10.

A recessed portion 11*a* is formed in a central part of the supporting member 2, on a side thereof which faces a print medium. Inside the recessed portion 11*a*, a recessed portion 11*b* having a smaller vertical and horizontal widths than the recessed portion 11*a* is formed deeper than the recessed portion 11*a*. Furthermore, inside the recessed portion 11*b*, a hole 13 smaller than the recessed portion 11*b* is formed deeper than the recessed portion 11*b*. The recessed portions 11*a* and 11*b* and the hole 13 penetrate the supporting member 2. The element substrate 3 is mounted in the recessed portion 11*b* so as to be accommodated therein.

The element substrate 3 is placed in the supporting member 2 such that when the element substrate 3 is placed in the recessed portion of the supporting member 2, the hole 13, formed deeper than the recessed portion 11*b* of the supporting member 2, is formed at a position corresponding to the ink supply port 7 in the supporting substrate 6. When the element substrate 3 is placed in the supporting member 2, the hole 13, which communicates with the ink supply port 7, constitutes an ink channel. Printing ink is fed to the element substrate 3 via the hole 13. Since the recessed portion 11*b* is formed to have larger vertical and horizontal widths than the element substrate 3 in the supporting substrate 6, the element substrate 3 is accommodated inside the recessed portion 11*b* such that the recessed portion 11*b* surrounds the element substrate 3.

In the present embodiment, the depth of the recessed portion 11*b* is such that when the element substrate 3 is accommodated inside the recessed portion 11*b*, an ejection port formation face 17 of the element substrate 3 on which the ejection port 9 is formed projects from the supporting member 2 in a direction in which ink is ejected. The space between the element substrate 3 and the supporting member 2 is filled with an adhesive 12 formed of an insulating material that prevents electrically from passing through. The element substrate 3 is fixed to the supporting member 2 with the adhesive 12.

In the present embodiment, connection wiring 14 formed of a conductive material is located on a supporting portion 19 formed by hardening the adhesive 12. The connection wiring 14 electrically connects between the wiring inside of the supporting member 4, which is provided in the supporting member 2, and the wiring inside of the element substrate 16, which is formed in the element substrate 3 and which is connected to the heat generating element 10. The wiring inside of the element substrate 16 is connected to the connection wiring 14 via the terminals 18. A sealing compound 15 is located on the connection wiring 14, located on the supporting portion 19, such that the connection wiring is covered with the sealing compound 15. The connection wiring 14 is covered with and thus protected by the sealing compound 15. This makes it possible to prevent the connection wiring 14 from contacting ends or corners of the element substrate 3 to damage the connection wiring 14.

In the present embodiment, the connection wiring 14 is supported by the supporting portion 19, formed by hardening the adhesive 12. Consequently, compared to the connection wiring 14 laid across directly between the element substrate 3 and the supporting member 2 without being supported by other elements, the connection wiring 14 in the present embodiment need not have a high strength. Since the connection wiring 14 is required only a little strength, the connection wiring 14 may be formed of only an amount of conductive material required to pass electricity between the wiring inside of the supporting member 4 which is formed in the supporting member 2, and the wiring inside of the element substrate 16 which is formed in the heat generating element 10. Thus, the connection wiring 14 is formed of a reduced amount of conductive material, allowing the connection wiring 14 to be formed thinner. Since the connection wiring 14 is formed thin, it is possible to reduce the amount by which the electric connection portion of the print head 1 projects in the ink ejection direction. In the present embodiment, even though the connection wiring 14 is covered with the sealing compound 15, the sealing compound 15 is positioned in an area located back from the ejection port formation face 17 of the print head 1, on which the ejection port 9 is formed, in the ink ejection direction. Consequently, the print head 1 can be formed such that the entire area of the electric connection portion is prevented from projecting from the ejection port formation face 17 of the print head 1 in the ejection direction. As a result, in the present embodiment, the ejection port formation face 17 of the flow path forming member 5, on which the ejection port 9 is formed, projects farthest in the ejection direction. Thus, when ink is ejected from the print head 1, the ejection port formation face 17 of the print head 1 can be located close to the print medium. This makes it possible to improve the landing accuracy of ink ejected from the print head 1.

Furthermore, in the present embodiment, the wiring inside of the supporting member 4 is not formed on a surface of the supporting member 2 but is located in the supporting member 2 so as to extend therethrough. Thus, a contact portion at which the wiring inside of the supporting member 4 and the connection wiring 14 are connected together is positioned in an area located more backward from the ejection port formation face 17 of the print head 1 with respect to the ink ejection direction. Since the contact portion between the wiring inside of the supporting member 4 and the connection wiring 14 is positioned in the area located more backward from the ejection port formation face 17 of the print head 1 with respect to the ink ejection direction, the contact portion as a whole is positioned in an area located back from the ejection port formation face 17 with respect to the ejection direction. Consequently, the ejection port formation face 17 of the print head 1 can be located closer to the print medium. This makes it possible to further improve the landing accuracy of ink ejected from the print head 1.

Now, with reference to FIGS. 3A to 3D, description will be given of a method for manufacturing the print head 1 according to the present invention. FIGS. 3A to 3D are diagrams illustrating a process of manufacturing the print head 1.

First, the flow path forming member 5 and the supporting substrate 6 are joined together to manufacture the element substrate 3. The wiring inside of the element substrate 16 is already formed on the supporting substrate 6 for connection to the heat generating element 10. The supporting substrate 6 is formed by patterning a wiring on a silicon wafer so as to form the wiring inside of the element substrate 16, which is a circuit used to drive the heat generating element 10. Furthermore, channels through which ink passes, such as the common liquid chamber 8 and the ejection port 9, are formed in the flow path forming member 5. Here, the size of the supporting substrate 6 is such that in the plan view in FIG. 1, a short side is about 2.5 mm, a long side is about 17.5 mm, and a height in the ejection direction is about 0.7 mm. The flow path forming member 5 has shorter sides than the supporting substrate 6 so that the short and long sides of the flow path forming member 5 are each located 0.25 mm inward of the corresponding end of the supporting substrate 6. The short side of the flow path forming member 5 is about 2 mm, the long side thereof is about 17 mm, and the height thereof in the ejection direction is about 20 μm. The flow path forming member 5 and supporting substrate 6 formed as described above are joined together.

The supporting member 2 is manufactured during almost the same period as that during which the element substrate 3 is manufactured. In this case, the manufacture of the supporting member 2 may precede or follow the manufacture of the element substrate 3. Alternatively, the supporting member 2 and the element substrate 3 may be simultaneously manufactured in parallel. Alternatively, the supporting member 2 and the element substrate 3 may be manufactured in different places and subsequently assembled together.

In the present embodiment, the supporting member 2 is formed by burning a stack of 15 green sheets. Each of the green sheets has a slot formed in a central part thereof and penetrating the sheet so as to allow the formation of the recessed portions 11*a* and 11*b* and the hole 13. The green sheets are divided into three blocks according to the positions of the sheets so as to allow the formation of the recessed portions 11*a* and 11*b* and the hole 13. The green sheets in a block A that is closest to the print medium, onto which ink is ejected, have a slot in the central part thereof which has a short side of about 3 mm and a long side of about 18 mm and from which the recessed portion 11*a* is formed. The green sheets in a block B that is second closest to the print medium have a slot in the central part thereof which has a short side of about 2.7 mm and a long side of about 17.7 mm and from which the recessed portion 11*b* is formed. The green sheets in a block C positioned farthest from the print medium have a hole having a diameter suitable for an ink channel through which ink is guided to the element substrate 3 and from which the hole 13 is formed. In the present embodiment, pre-patterning is used to form the slots from which the recessed portions 11*a* and 11*b* are formed and the hole from which the hole 13 constituting the ink channel is formed.

Figure 3A:
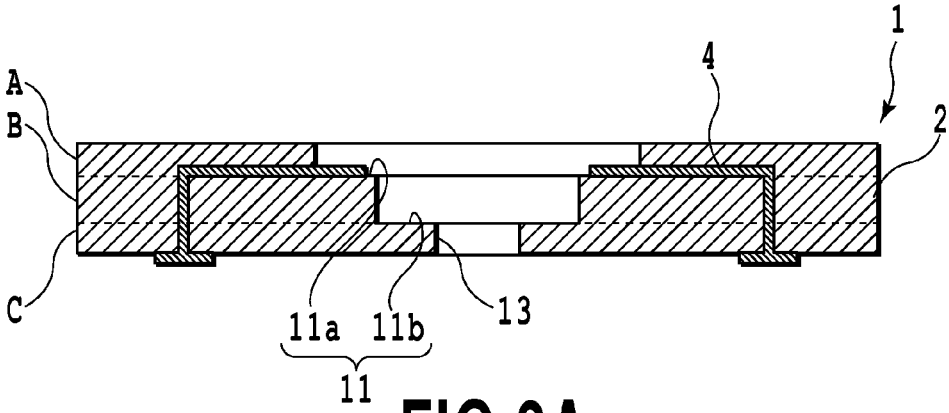

The wiring inside of the supporting member 4 is formed, by patterning, in the green sheets between the block A, which is one of the three blocks and is closest to the print medium, and the block B, which is also one of the three blocks and is second closest to the print medium. In the present embodiment, the patterning of the wiring inside of the supporting member 4 on the green sheets is performed by photolithography. Holes formed through a plurality of the green sheets in the ejection direction are also formed by patterning such that the wiring inside of the supporting member 4 can be passed through the holes. In this case, the patterning of the wiring on the green sheets is not limited to a technique using photolithography but may be performed by another patterning method for the conventional wiring, for example, a printing method such as screen printing. Thus, in the present embodiment, the following are all preformed on the green sheets by patterning: the slots from which the recessed portion 11 is formed, the hole from which the hole 13 constituting the ink channel portion is formed, and the wiring for electric feeding. The green sheets are burned to form the supporting member 2 as shown in FIG. 3A.

Figure 3B:
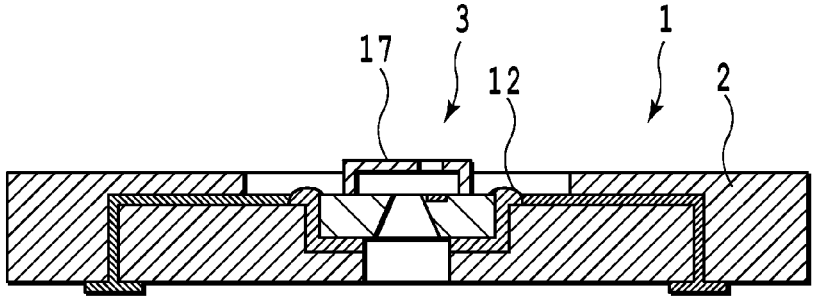

In a step of placing the element substrate, first, the element substrate 3 is placed in the recessed portion 11*b* of the supporting member 2 manufactured as described above. To be placed inside the recessed portion 11*b*, the element substrate 3 is embedded in the recessed portion 11 of the supporting member 2 with an appropriate amount of thermosetting epoxy resin as an adhesive filled into the space between the element substrate 3 and the supporting member 2 as shown in FIG. 3B. In this condition, the print head 1 having the element substrate 3 and the supporting member 2 is heated at 150° C. for 15 minutes to harden the thermosetting epoxy resin. The element substrate 3 is thus fixed to the supporting member 2.

The adhesive is not particularly limited provided that the adhesive is an insulating adhesive material. Instead of the epoxy resin, polyimide resin may be used. The materials for the adhesive harden at temperatures equal to or lower than 200° C., taking into account a thermal effect during the manufacturing process.

Figure 3C:
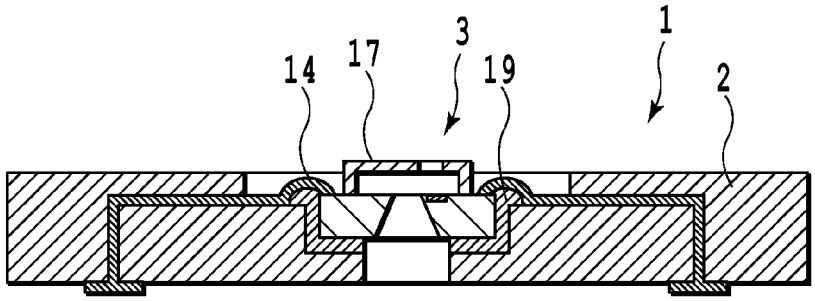

The process then shifts to a connection wiring forming step. As shown in FIG. 3C, the connection wiring 14 is formed using a conductive material, so as to be supported by the supporting portion 19, and formed by hardening the adhesive filled into the space between the element substrate 3 and the supporting member 2. Thus, the adhesive filled between the element substrate 3 and the supporting member 2 constitutes the supporting portion 19. The conductive material used to form the connection wiring 14 in the connection wiring forming step is conductive particles ejected from an ink jet head. The connection wiring 14 is an aggregate of the conductive particles. In the present embodiment, the conductive particles are placed on the supporting portion by ejecting silver nanopaste from the ink jet head. The ink jet head from which the silver nanopaste is ejected is a liquid ejection head having an ejection port through which droplets are ejected and an ejection energy generating element that generates energy required to eject droplets. The silver nanopaste is ejected onto the supporting portion 19 and then burned to form the connection wiring 14. In this case, burning conditions are such that the silver nanopaste is heated at 180° C. for 60 minutes. In the present embodiment, after the burning, the silver nanopaste is ejected onto the supporting portion 19 so that the connection wiring 14 formed of the silver has a thickness of about 5 μm.

Thus, the silver nanopaste is applied by ejecting the nanopaste from the ink jet head. Consequently, exactly a predetermined amount of silver nanopaste is placed on the supporting portion 19. This makes it possible to prevent, during the formation of the wiring, the wiring from having locally too large a height as a result of a failure to accurately place the material for the wiring. And this makes it possible to prevent a part of print head 1 from projecting to the ink ejection direction. A much shorter distance can thus be maintained between the print head 1 and the print medium, making it possible to maintain the high landing accuracy of ejection from the print head 1. Furthermore, an accurate amount of wiring material can be ejected, allowing a reduction in the amount of wiring material used. Therefore, the manufacturing costs of the print head 1 can be reduced.

In the present embodiment, the silver nanopaste is used as the conductive material constituting the connection wiring 14. However, the present invention is not particularly limited to this; any appropriate conductive material may be used. However, with the thermal effect during manufacture taken into account, the material hardens at low temperatures equal to or lower than 200° C. In this connection, the silver nanopaste is preferably used.

Figure 3D:
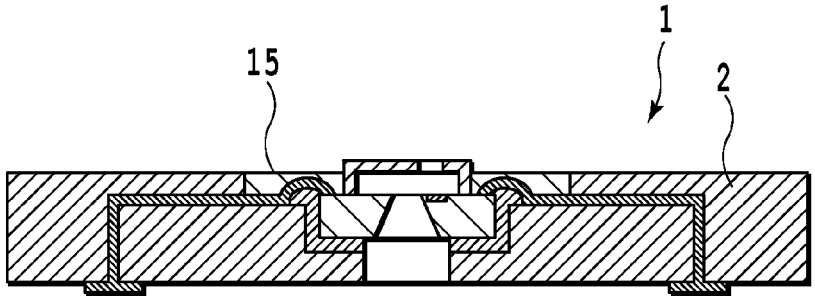

Furthermore, after the connection wiring forming step, the connection wiring 14 is covered with the sealing compound 15 as shown in FIG. 3D. In the present embodiment, the sealing compound 15 is applied to the print head 1 by ejecting the sealing compound 15 from the ink jet head in the ink jet apparatus as is the case with the ejection of the silver nanopaste described above. The hardening of the thermosetting epoxy resin as the sealing compound 15 was achieved by heating the resin at 150° C. for 15 minutes. In the present embodiment, the epoxy resin was patterned such that after the epoxy resin hardened, the resulting coating film had a thickness of about 5 μm.

The sealing compound 15 is not particularly limited provided that the compound 15 can keep covering the connection wiring 14. Instead of the epoxy resin, a silicon material may be used. However, with the thermal effect during manufacture taken into account, the sealing compound 15 hardens at low temperatures equal to or lower than 200° C.

When the application of the sealing compound 15 is performed by ejecting the sealing compound 15 from the ink jet head in the ink jet apparatus, exactly a predetermined amount of sealing compound 15 can be applied to the connection wiring 14 as is the case with the silver nanopaste. This makes it possible to prevent the possible situation in which during the application of the sealing compound 15, the amount of the sealing compound 15 cannot be accurately adjusted, making the resulting sealing compound 15 locally too high. The sealing compound in the print head 1 can thus be prevented from projecting partly in the ejection direction. A much shorter distance can thus be maintained between the print head 1 and the print medium, making it possible to maintain the high landing accuracy of ejection from the print head 1. Furthermore, an accurate amount of sealing compound can be ejected, allowing a reduction in the amount of sealing compound used. Therefore, the manufacturing costs of the print head 1 can be reduced as is the case with the amount of silver nanopaste used.

In the print head 1, whether or not the ejection port formation face 17 of the element substrate 3 projects also depends on the amount of sealing compound 15 applied. If the sealing compound 15 is too thick, the sealing compound 15 projects from the ejection port formation face, preventing the ejection port formation face 17 from being located close to the print medium. If the sealing compound 15 is too thin or the application of the sealing compound 15 is avoided with the connection wiring 14 exposed, the connection wiring 14 may be damaged by an external impact or the like. Moreover, whether or not the ejection port formation face 17 projects in the ejection direction depends on the accuracy of dimensions of appropriate components such as the depth of the recessed portion 11 set during the manufacture of the supporting member 2. The position of the ejection port formation face 17 varies depending on the depth of the recessed portion 11*b*, in which the element substrate 3 is placed, or other dimensions of the supporting member 2. Thus, the conventional manufacture of the print head requires the accurate formation of the supporting member and the accurate adjustment of the amount of sealing compound applied in order to minimize the projection of the areas of the element substrate other than the ejection port formation face in the ejection direction. Since the element substrate is a thin component, the manufacture of the supporting member and the application of the sealing compound need to be relatively accurate in order to allow the ejection port formation face to project from the supporting member. Thus, the conventional techniques require too strict dimensional accuracy for the manufacture of the print head as well as much time and effort for the manufacture.

However, the method for manufacturing the print head 1 according to the present embodiment allows the components other than the element substrate 3 to be positioned in an area located more backward from the ejection port formation face 17 compared to the conventional techniques. Thus, even if an error occurs in the amount of sealing compound 15 applied or a dimensional error occurs during the manufacture of the supporting member 2, the error can be absorbed, making it possible to keep the components other than the element substrate 3 positioned in an area located back from the ejection port formation face 17. Since the possible error occurring during the manufacture of the print head 1 can thus be absorbed, the error can be taken into account in a design stage, allowing freer design. This increases the degree of freedom of the design.

Furthermore, the method for manufacturing the print head 1 according to the present embodiment ensures the appropriate space into which the sealing compound 15 is applied while maintaining the appropriate landing accuracy. The connection wiring 14 is thus protected by the sealing compound 15, improving the durability of the print head 1.

Additionally, according to the method for manufacturing the print head 1 according to the present embodiment, the adhesive hardens to constitute the supporting portion 19. This eliminates the need to provide a new supporting portion. The manufacturing costs of the print head 1 can thus be reduced. Furthermore, the step of placing the supporting portion 19 can be omitted, allowing the manufacturing process to be shortened and simplified.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-123664, filed May 8, 2007, which is hereby incorporated by reference herein in its entirety.

What is claimed is:

1. A liquid ejection head comprising:

an element substrate having an ejection port for ejecting liquid, an ejection energy generating element configured to generate energy to eject liquid, and a terminal electrically connected to the ejection energy generating element;

a wiring member comprising wiring through which electricity is transmitted to drive the ejection energy generating element and a recessed portion in which the element substrate is accommodated;

a connection wiring connecting the wiring of the wiring member and the terminal; and a supporting portion supporting the connection wiring, wherein the connection wiring, is formed by arranging conductive material on the supporting portion, and wherein an outer face of the wiring member in a direction in which the liquid is ejected is positioned in an area located back from the element substrate more than a face at which the ejection port is formed in the direction.

2. The liquid ejection head according to claim 1, wherein the supporting portion is an adhesive filled into a space between the element substrate and the wiring member, the element substrate is fixed to the wiring member with the adhesive.

3. The liquid ejection head according to claim 1, wherein the supporting portion is formed of an insulating material.

4. The liquid ejection head according to claim 1, wherein the connection wiring is covered with a sealing compound, and an outer face of the sealing compound in the direction is positioned in an area located back from the face at which the ejection port is formed in the element substrate in the direction.

5. The liquid ejection head according to claim 1, wherein the wiring of the wiring member is located through the wiring member.

6. The liquid ejection head according to claim 1, wherein the connection wiring is positioned in an area located back from the face at which the ejection port is formed of the element substrate in the direction.

7. The liquid ejection head according to claim 1, wherein the face, at which the ejection port is formed, in the element substrate projects farthest in the direction.

8. The liquid ejection head according to claim 1, wherein the connection wiring formed by the conductive material, which is in paste form, is applied on the supporting portion.

* * * * *